United States Patent [19]

Fowler

[11] 4,287,901

[45] Sep. 8, 1981

[54] APPARATUS FOR WASHING EGG INCUBATING AND/OR HATCHING TRAYS AND BUGGIES THEREFOR

[75] Inventor: Douglas Fowler, 5145 Merry La., Gainesville, Ga. 30501

[73] Assignee: Douglas Fowler, Hall County, Ga.

[21] Appl. No.: 152,829

[22] Filed: May 23, 1980

Related U.S. Application Data

[62] Division of Ser. No. 915,234, Jun. 13, 1978, Pat. No. 4,227,938.

[51] Int. Cl.[3] ..... B08B 3/02

[52] U.S. Cl. ..... 134/56 R; 134/72; 134/131; 134/199; 134/200; 239/208

[58] Field of Search ..... 134/56 R, 61, 64 R, 134/64 P, 68, 70, 72–73, 82, 129, 131, 151, 199, 200, 45, 123; 239/208

[56] References Cited

U.S. PATENT DOCUMENTS

| | | | |
|---|---|---|---|
| 2,586,620 | 2/1952 | De Hart | 134/200 X |
| 2,698,627 | 3/1949 | Kearney et al. | 134/72 X |
| 3,034,933 | 5/1962 | Richards | 134/56 R X |
| 3,267,943 | 8/1966 | Kuhl et al. | 134/72 |
| 3,593,730 | 7/1971 | Burchett | 134/123 |
| 3,706,317 | 12/1972 | Fox et al. | 134/72 X |
| 4,073,663 | 2/1978 | Lundgren | 134/56 R X |

*Primary Examiner*—Robert L. Bleutge

*Attorney, Agent, or Firm*—Diller, Ramik & Wight

[57] ABSTRACT

This disclosure relates to apparatus for washing trays and/or buggies, and includes a housing having means therein for conveying buggies from an entrance opening to an exit opening through respective washing and rinse zones beneath which are respective wash water and rinse water collecting reservoirs, a plurality of nozzles in the washing zone disposed in an inverted generally U-shaped configuration for directing high pressure streams of wash water downwardly and across the washing zone, a plurality of nozzles disposed at an upper area of the rinse zone for directing rinse water generally downwardly through the rinse zone, and means responsive to detecting means for detecting the level of collected wash water and rinse water in the respective washing and rinse reservoirs for adding make-up water to the washing and rinse nozzles.

11 Claims, 6 Drawing Figures

APPARATUS FOR WASHING EGG INCUBATING AND/OR HATCHING TRAYS AND BUGGIES THEREFOR

This is a division, of application Ser. No. 915,234 filed on June 13, 1978 and now U.S. Pat. No. 4,227,938.

In keeping with past practice, eggs which are to be incubated and/or hatched are disposed in flats or trays and are placed in suitable heated incubating chambers. After the hatching has been completed, the trays must be cleaned before reuse to remove chick down, egg shells, dead embryos, etc. These trays are simply washed and disinfected in a standard commercial tray and/or dishwasher. The soiled trays and/or flats are loaded on a buggy in an egg room, transferred therefrom to a wash area, removed from the buggies, manually cleaned of heavy dirt, placed in the tray and/or dishwasher in the manner noted, removed from the latter, and placed upon buggies for reloading of fresh eggs for subsequent incubation and/or hatching. The buggies which carry the flats and/or trays in stacked relationship on suitable shelves are separately washed, and in a typical operation approximately ten man hours are utilied to wash and disinfect thirty buggies and the flats associated therewith, and this is done typically four times a week.

At times the recycling does not permit the buggies to be washed between cycling from and back to the egg room because of the time required for washing the trays and/or flats. Therefore, the buggies are simply placed in the hatcher room or in another convenient area until late afternoon or at night while some of the buggies necessarily must be returned to the farm for fresh eggs.

In keeping with the present invention, a novel apparatus is provided through which the buggies per se or buggies carrying the egg flats and/or trays are washed and rinsed, along with being disinfected in approximately two minutes, thereby appreciably lessening the man hours conventionally required for such operations and permitting immediate recycling or transfer of buggies and/or trays between the farm, egg room, incubation and/or hatching areas and the like.

A primary object of this invention is to provide a novel apparatus of the type aforesaid for washing articles, particularly buggies per se and buggies containing stacked egg trays and/or flats, including a housing having means for conveying the buggy or like carrier between an entrance opening and an exit opening through respective washing and rinse zones having respective washing and rinse nozzles for directing streams of water against the buggies, trays or like articles, reservoir means within each of the washing and rinsing zones, and means for recycling collected wash water and rinse water from the respective washing and rinse reservoirs to and through the respective nozzles thereof.

Still another object of this invention is to provide a novel apparatus of the type heretofore described including means for detecting the level of collected wash water and rinse water in the respective washing and rinsing reservoirs and means responsive to a low level of collected wash water and rinse water for adding make-up water to the washing and rinsing nozzles.

Yet another object of this invention is to dispose the plurality of rinse nozzles in a generally T-shaped configuration as viewed in top plan at an upper area of the rinse zone whereby the streams of rinse water are directed generally downwardly across and along the rinse zone with the T-shaped configuration preferably being defined by a leg disposed generally along a longitudinal centerline of the housing and an arm transversed thereto.

A further object of this invention is to provide a novel apparatus of the type described including means for guiding buggies or like carriers through the housing in the form of a pair of tracks spaced different distances from each other to guidingly accommodate carriers of different dimensions through the housing.

Still another object of this invention is to provide a novel apparatus for washing articles wherein the washing nozzles are disposed in a generally inverted U-shaped configuration whereby high pressure streams of wash water are directed both downwardly and across the washing zone.

Still another object of this invention is to provide the conveying means in the form of an endless member disposed along a longitudinal centerline of the housing and having a plurality of pusher elements spaced therealong for abuttingly contacting the carrier and/or buggy as an upper run of the endless member moves from the entrance opening toward the exit opening of the housing.

A further object of this invention is to provide a novel method of washing egg incubating and/or hatching trays and buggies therefor by establishing a washing zone within which a plurality of streams of high pressure wash water are directed into the washing zone from above, below and opposite sides, conveying the trays stacked within the buggies through the washing zone, collecting wash water drained from the washing zone and recycling the same through the washing zone, establishing a rinse zone within which a plurality of streams of rinse water are directed into the rinse zone from above, collecting rinse water drained from the rinse zone and recycling the same through the rinse zone, and conveying the buggies with the trays stacked therein directly from the washing zone into and through the rinse zone.

Still another object of this invention is to provide a novel method of the type set forth immediately herebefore including that of collecting wash water in a reservoir prior to the recycling thereof, measuring the level of the wash water within the reservoir, and adding wash water upon a low level measurement of wash water within the reservoir.

Another object of this invention is to provide a novel method which further includes that of collecting rinse water in a reservoir prior to the recycling thereof, measuring the level of the rinse water within the reservoir, and adding rinse water upon a low level measurement of rinse water within the reservoir.

With the above and other objects in view that will hereinafter appear, the nature of the invention will be more clearly understood by reference to the following detailed description, the appended claims and the several views illustrated in the accompanying drawings.

IN THE DRAWINGS

FIG. 1 is a highly schematic view of a novel apparatus for washing buggies and/or trays or flats, and illustrates a housing in phantom outline having a plurality of nozzles disposed in washing and rinse zones, guide tracks and a conveyor for conveying buggies between entrance and exit openings of the housing, a reservoir associated with each of the washing and rinse zones, and a water level detecting and recycling system.

Figure 1:
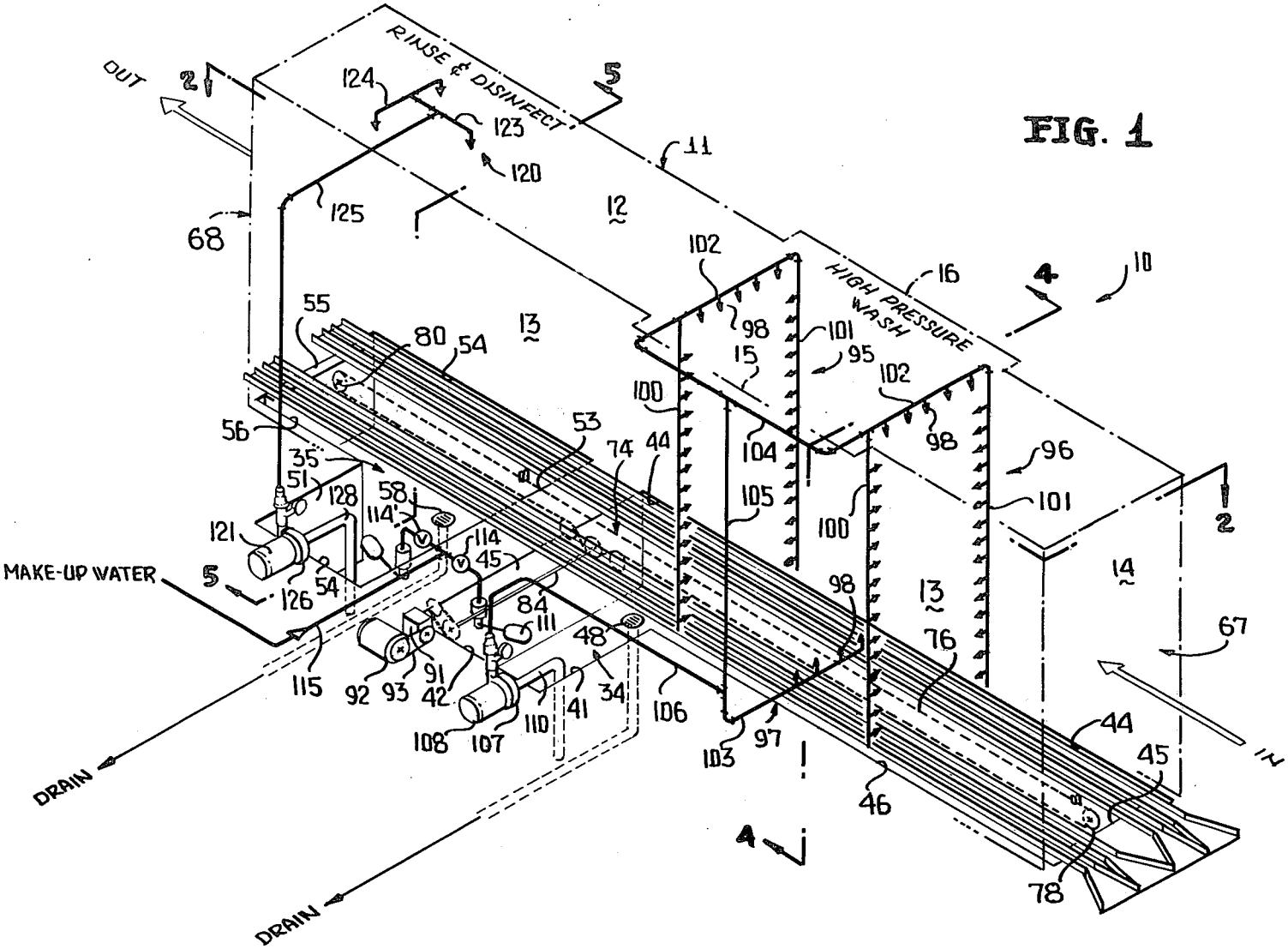
Figure 2:
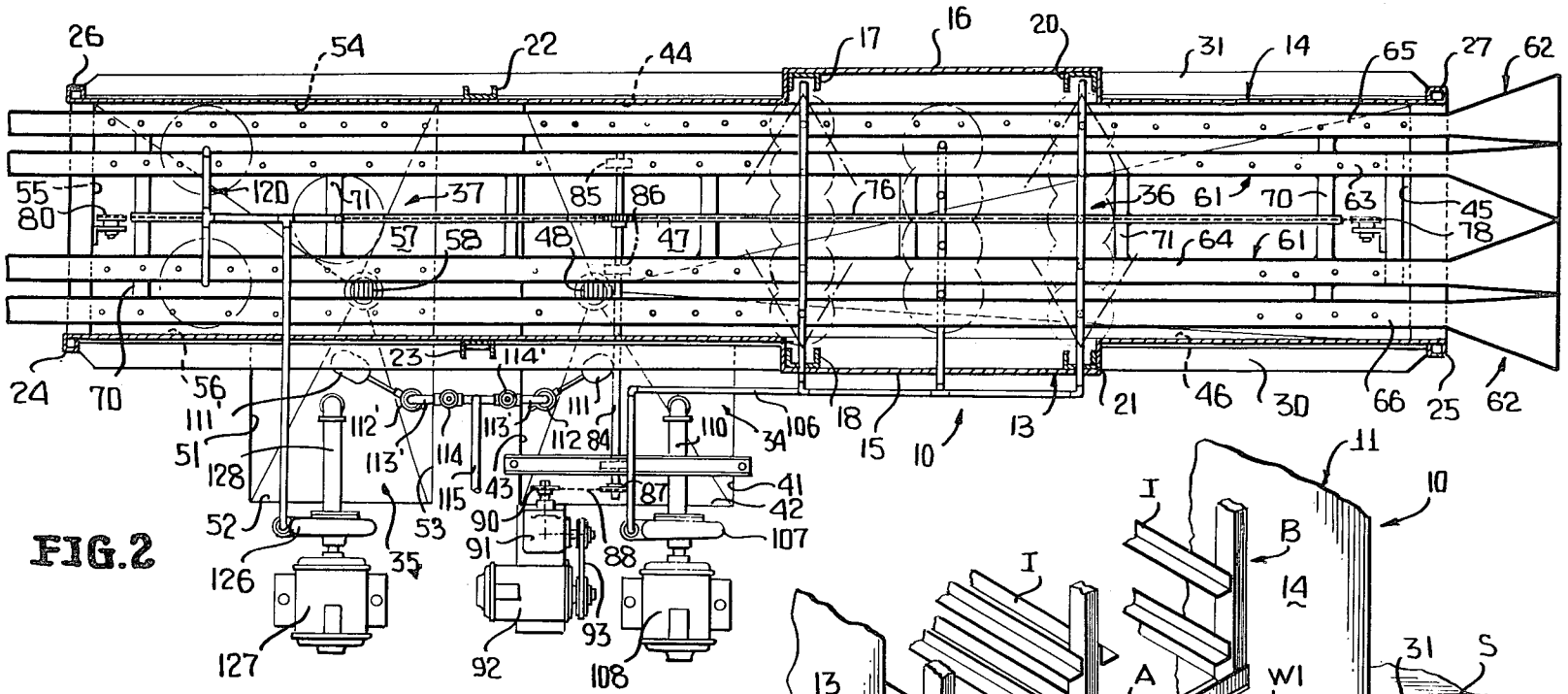
FIG. 2 is a sectional view taken generally along line 2—2 of FIG. 1 and illustrates details of the housing, nozzles, guide tracks, conveyor, reservoirs, etc.

A novel apparatus for washing articles, such as egg flats or egg trays, carried by a carrier, such as a wheeled buggy, is generally designated by the reference numeral 10 and includes a housing 11 constructed of metallic, plastic or like material having a top wall 12 and a pair of generally vertically disposed side walls 13, 14. Wall portions 15, 16 (FIGS. 1 and 2) of the side walls 13, 14, respectively, are offset outwardly and are internally reinforced by vertically upstanding U-shaped channels or beams 17, 18, 20 and 21 (FIG. 2). Similar channels or beams 22, 23 are positioned exteriorly of the side walls 14, 13, respectively, as are tubular columns 24, 25 formed from the material of the side wall 13 bent upon itself and like tubular columns 26, 27 of the side wall 14. The columns 24 through 27 may, of course, be formed from separate pieces of metallic material welded or otherwise fastened to the side walls of the housing 11. Lower edges (unnumbered) of the side walls 13, 14 are welded to angle irons 30, 31 which extend the length of the housing 11 and rest upon a conventional supporting surface S, such as a concrete floor.

Figure 5:
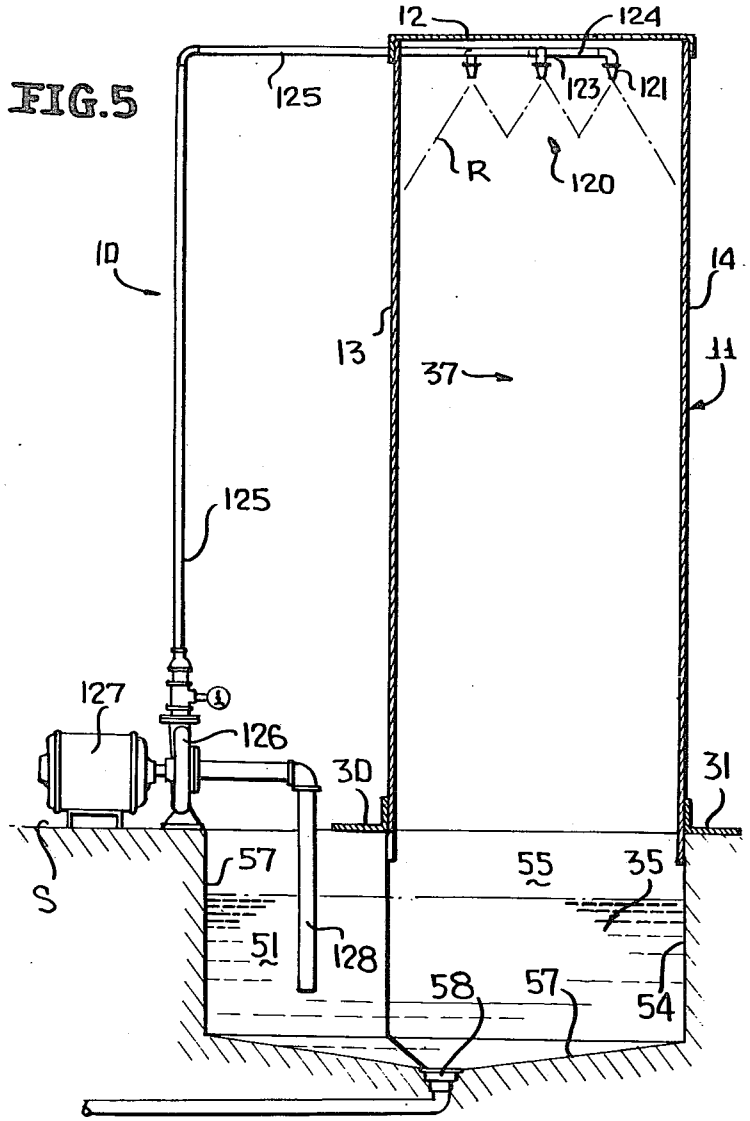
FIG. 5 is a sectional view taken generally along line 5—5 of FIG. 1 and illustrates a plurality of nozzles in an upper area of the rinse zone.

The entire bottom (unnumbered) of housing 11 is open and the length of the side walls 13, 14 therealong include inwardly and downwardly inclined wall portions 32, 33 which serve to direct wash water W (FIG. 4) and rinse water R (FIG. 5) into respective wash water and rinse water reservoirs 34, 35. The wash or washing water reservoir 34 and the rinse water reservoir 35 lie directly beneath respective washing and rinsing zones 36, 37 of the housing 11. Thus, the washing water W draining from the inclined wall portions 32, 33 will collect in the wash water reservoir 34 while the rinse water collecting from the like inclined wall portions 32, 33 will collect in the rinse water reservoir 35.

The washing reservoir 34 is generally of an L-shaped configuration as viewed in top plan (FIG. 2) and is defined by a plurality of generally vertical walls 41 through 46 and a bottom wall 47 inclined from several directions toward a drain 48. The walls 44, 46 parallel each other as do the walls 43, 45. Portions of the walls 41, 43 and the entire wall 42 are located externally of the side wall 43 of the housing 11, as is best illustrated in FIG. 2.

The rinse water reservoir 35 is likewise of a generally L-shaped configuration, as viewed in top plan, and as defined by a plurality of vertical walls 51 through 56 and a bottom wall 57 having a plurality of sloping portions (unnumbered) which slope toward and terminate at a drain 58. The walls 54, 56 are immediately adjacent the respective side walls 14, 13 whereas portions of the walls 51, 53 and the wall 52 are located externally of the housing 11 adjacent the side wall 13, in the manner best shown in FIG. 2. The walls 43, 53 extend upwardly from the respective bottom walls 47, 57 to the upper surface S thereby separating the wash water reservoir 34 from the rinse water reservoir 35.

The entire length of the housing 11 is spanned by guide means in the form of two pair of guide tracks 61, 62 in the form of upwardly opening generally U-shaped channels having a plurality of drain apertures (unnumbered) formed therein. Individual guide channels 63, 64 of the pair of guide channels 61 are transversely closer to each other than individual guide channels 65, 66 of the pair of guide channels 62 to accommodate buggies of two different wheel base dimensions. The pairs of guide means 61, 62 are supported upon the surface S at both an entrance opening 67 (FIG. 1) and an exit opening 68 of the housing 11, as well as the portion of the surface S between the walls 43, 53 (FIG. 2). The individual channels 63 through 66 are reinforced by a plurality of transverse cross braces 70, 71 welded or otherwise suitably secured thereto.

Figure 6:
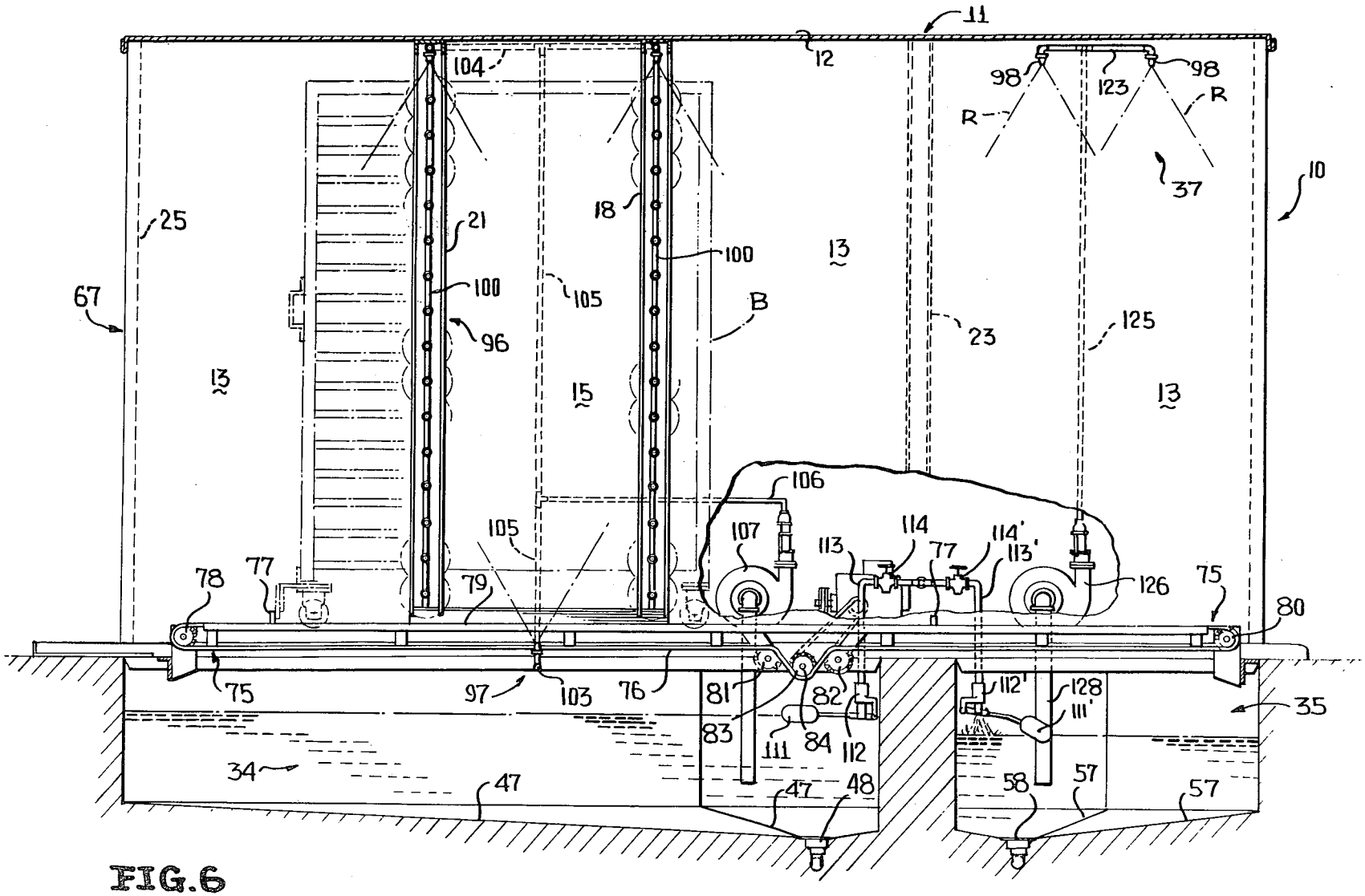
FIG. 6 is a sectional view taken generally along line 6—6 of FIG. 4 and illustrates details of a drive mechanism for the conveyor and water level sensing means in the washing and rinse reservoir.

Conveying means generally designated by the reference numeral 75 is provided for conveying buggies through the housing 11 from the entrance opening 67 to the exit opening 68. The conveying means is an endless member 76 in the form of a chain conveyor having a plurality of pusher elements 77 projecting therefrom in the manner best illustrated in FIG. 3. The chain 76 has an upper run or flight which is supported upon an upwardly opening U-shaped channel 79 which is suitably supported along the longitudinal center line of the housing 11, as is best illustrated in FIGS. 4 and 6. The chain 76 is entrained about sprockets 78, 80 at the respective entrance opening 67 and the exit opening 68, as well as about a pair of generally medially disposed sprockets 81, 82 and a drive sprocket 83. Each of the sprockets is freely rotatable relative to support shafts (unnumbered) suitably connected to the housing 10 except for the sprocket 83 which is keyed to a shaft 84 and is suitably journaled for rotation in a pair of bearings 85, 86 (FIG. 2). The shaft 84 has key thereto another sprocket 87 about which is entrained a drive chain 88 which is also entrained about a drive sprocket 90 which is in turn keyed to a shaft (unnumbered) of a gear reducer 91. The gear reducer 91 is driven by a conventional electric motor 92 through a drive belt 93 and associated pulleys (unnumbered) and shafts (unnumbered) associated with the gear reducing drive 91 and the electric motor 92. Energization of the electric motor 92 will move an upper run (unnumbered) of the conveyor chain 75 from left-to-right, as viewed in FIG. 6, to move a carrier or buggy through the housing 10, as will be described more fully hereinafter.

During the movement of the buggy or carrier through the washing zone 36, the same is washed by high pressure water, preferably admixed with a detergent, which is emitted from a plurality of nozzles arranged in three groups 95, 96 and 97.

The groups of nozzles 95 and 96 are disposed in an inverted generally U-shaped configuration (FIG. 1) and individual nozzles 98 thereof are carried by depending tubular conduits or pipes 100, 101 and a bridging conduit or pipe 102 with the individual nozzles 98 being so positioned to direct the wash water W issuing therefrom downwardly from the nozzles 98 of the conduits 102 and sidewise toward each other from the nozzles 98 carried by the conduits 100, 101 (FIG. 4). The individual nozzles 98 of the group of nozzles 97 are carried by a conduit 103 and are directed upwardly to direct the wash water W in a vertically upward direction, as is best illustrated in FIG. 4. The conduits 102 are connected to the conduit 103 by suitable conduits or pipes 104 and 105 while the latter conduit or pipe 105 is connected by conduit or pipe 106 to a centrifugal pump 107 driven by an electric motor 108 with an inlet (unnumbered) of the centrifugal pump being connected to a pipe 110 having a lower end (unnumbered) adjacent the bottom wall 47 (FIG. 6) of the wash water reservoir 34. Thus, upon energization of the electric motor 108, wash water, along with suitable detergents, is drawn from the wash water located within the reservoir 34 and is delivered through the conduits or pipes 106, 103, etc. to the various nozzles 98.

As water is lost from the wash water reservoir 34, the same is replenished when the level of the water within the reservoir 34 falls below a desired minimum by means of a water level detecting means including a conventional float 111 (FIGS. 2 and 6) connected to a valve 112 in a pipe or conduit 113 which in turn includes a manually operated on-off valve 114, which is in turn connected by a pipe 115 to a conventional source of water (MAKE-UP WATER). Thus, as the level of the wash water within the reservoir 34 is reduced to a predetermined minimum level, the float 111 pivots downwardly in a conventional manner opening the valve 112 to deliver make-up water into the reservoir 34 with a suitable detergent which can be conventionally introduced into the reservoir 34 or the pipe 106 (not shown).

Associated with the rinse zone 37 are nozzle means 120 (FIGS. 1 and 5) which include a plurality of downwardly directed nozzles 121 located at an upper area of the rinse zone 37 adjacent the top wall 12. The nozzles 121 are disposed in a generally T-shaped configuration (FIGS. 1 and 2) defined by a pipe or conduit 123 disposed generally along a longitudinal centerline of the housing 11 and a pipe or conduit 124 disposed transversely thereto. The pipe 123 is connected by a pipe 125 to the high pressure outlet side of a centrifugal pump 126 driven by an electric motor 127 with an input side of the centrifugal pump 126 being connected to a pipe 128 having a lower end portion (unnumbered) disposed adjacent but above the bottom wall 57 of the rinse reservoir 35 (FIG. 6).

In addition to recycling the rinse water from the reservoir 35 through the pump 126, the rinse zone 37 also includes a water level detecting device comparable to that utilized in the washing zone 36 and, thus, like elements are identically numbered but primed.

Figure 3:
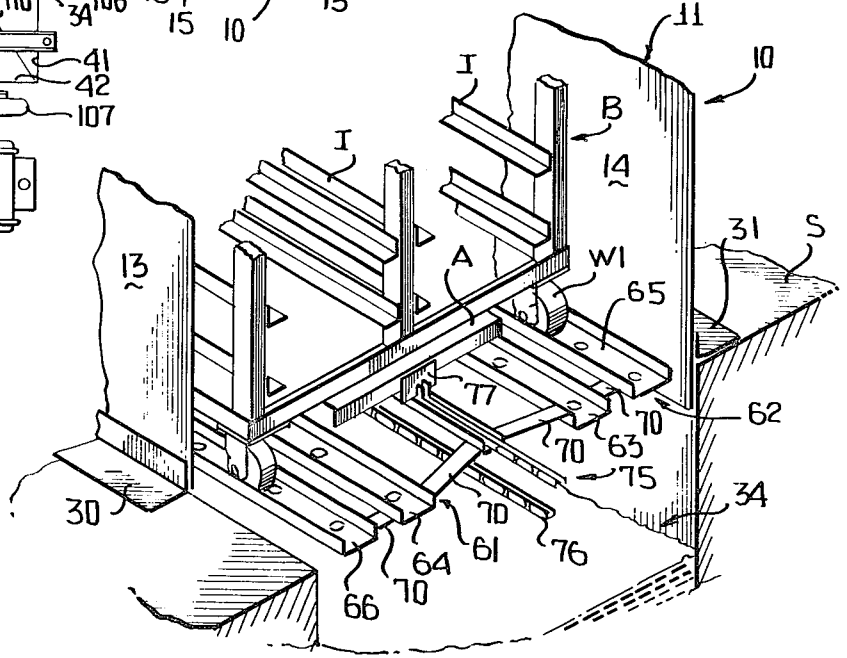
FIG. 3 is an enlarged fragmentary perspective view of a portion of the apparatus and illustrates the manner in which a typical wheeled buggy is guided and conveyed through the housing by pusher elements of the conveyor.
Figure 4:
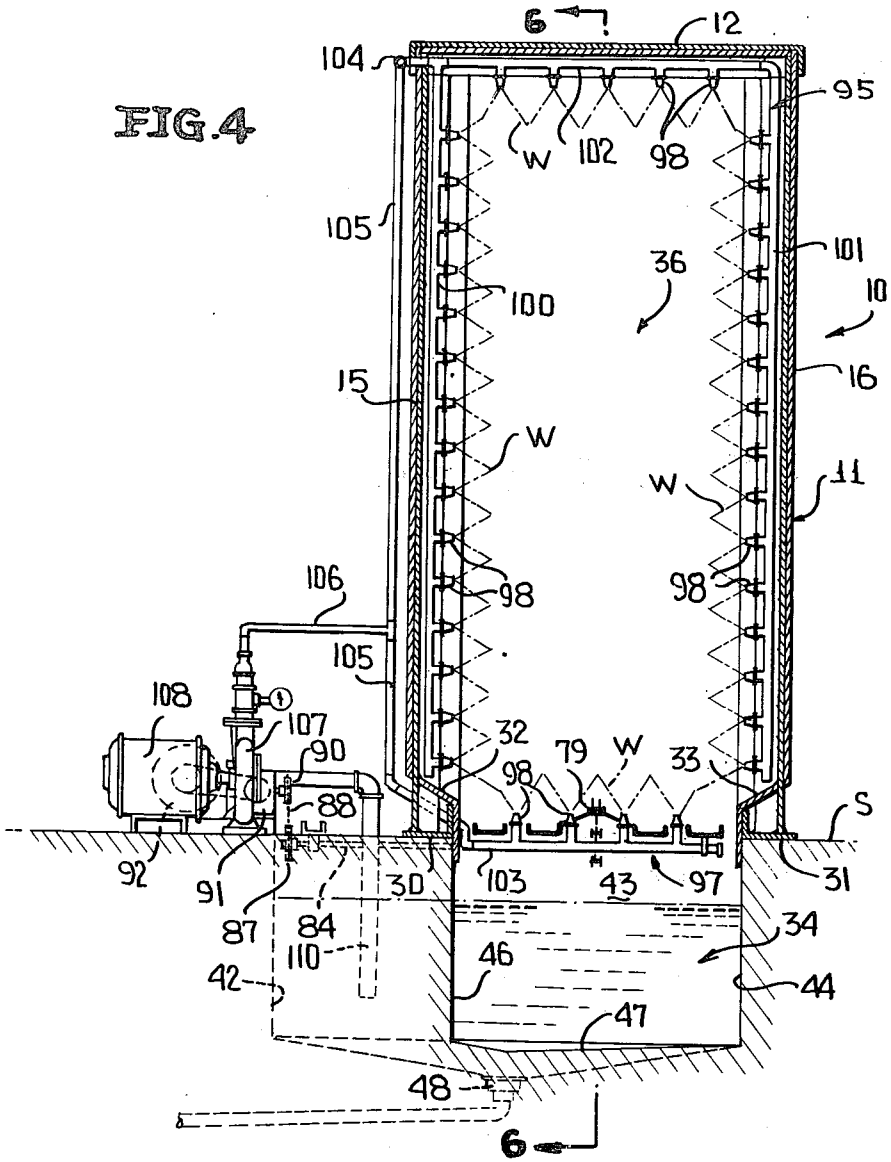
FIG. 4 is an enlarged sectional view taken generally along line 4—4 of FIG. 1, and illustrates one of a pair of groups of nozzles in the washing zone disposed in a generally inverted U-shaped configuration, and a set of lower nozzles between the groups of nozzles.

Reference is now made to FIG. 3 of the drawings which illustrates a typical buggy or carrier B formed of a metallic frame work and having welded thereto a plurality of angle irons I whose opposing horizontal flanges (unnumbered) are aligned to form a plurality of tracks or shelves onto which egg trays or flats can be slid into or slid from the buggy B. The buggy B also includes conventional wheels W1 at each of four corners thereof, only two of which are shown, which in the embodiment of the invention illustrated in FIG. 3 ride in the outermost guide rails or channels 65, 66 of the pair of guide rails 62 while, of course, a narrower buggy (not shown) would have comparable wheels which would ride in and be guided by the innermost rails 63, 64 of the pair of guide rails 61. An angle iron A is welded to a portion of the frame (unnumbered) of the buggy B and is contacted by the pusher element 77 of the conveyor chain 75.

The apparatus 10 may be utilized to clean the buggy B per se, or the buggy B along with the egg trays and/or flats stacked therein upon the horizontal flanges of the angle irons I. In either event, the buggy is wheeled upon either of the pairs of guide means 61, 62 through the entrance opening 67 at which time it is presumed that the electric motor 92 is energized to move the upper run or flight of the conveyor chain 75 to the left as viewed in FIGS. 1 and 2. After the buggy B has been manually positioned within the housing 11 sufficiently within the entrance opening 67, one of the pusher elements 77 of the conveyor chain 75 contacts the angle iron A and pushes the buggy B through the entire housing 11 and outwardly of the exit opening 68 thereof. During the passage of the buggy B with or without the trays or flats associated therewith, the same is first subjected to high pressure wash water W emitted from the nozzles 98 of the pipes 100 through 102 followed by the buggy then being washed through the effect of the wash water W being emitted from the nozzles 98 of the pipe 103 in an upward direction. In this manner all sides of the buggy B and the flats associated therewith are virtually thoroughly cleansed and any material remaining is removed upon the buggy next passing through the final streams of wash water W issuing from the nozzles 98 of the group of nozzles 95. As the wash water is emitted from the nozzles 98, the same runs into the wash water reservoir 34 and is recycled by means of the energized electric motor 108 in the manner heretofore described.

After the buggy B has been conveyed through the washing zone 36, it enters the rinsing and disinfecting zone 37 at which time rinse water R, with or without disinfectant, issuing downwardly from the nozzles 121 thoroughly cleanses and disinfects the buggy B and the trays or flats associated therewith, again with the rinse water being recirculated by means of the centrifugal pump 126 and the conduits or pipes associated therewith. The level of the water in both of the reservoirs 34, 35 is monitored in the manner heretofore described and make—up water is delivered to the nozzles in both the washing zone 36 and the rinse zone 37 as dictated by the operation of the floats 111, and 111'. After having exited the exit opening 68, the buggy and/or flats and trays associated therewith is now ready for reuse and, of course, more than a single buggy is introducted into and through the housing 11 and, thus, the distance between the pusher elements 77 is selected such that an optimum number of buggies B can be conveyed sequentially through the apparatus 10.

Although only a preferred embodiment of the invention has been specifically illustrated and described herein, it is to be understood that minor variations may be made in the apparatus without departing from the spirit and scope of the invention, as defined in the appended claims.

I claim:

1. An apparatus for washing articles comprising a housing having an entrance opening and an exit opening, means for conveying a carrier carrying articles to be washed from said entrance opening to said exit opening, said housing setting off a washing zone contiguous said entrance opening and a rinse zone contiguous said exit opening, means for guiding a carrier from said entrance opening to said exit opening during the conveyance thereof by said conveying means, nozzle means in said washing zone for directing a plurality of streams of water against articles conveyed through said washing zone by the carrier, said housing having opposite side walls, and said side walls being recessed for receiving therein and protecting said nozzle means against contact by a carrier conveyed through said housing by said conveying means.

2. The apparatus as defined in claim 1 wherein said recessed side walls include portions which open toward each other and are generally U-shaped as viewed in longitudinal cross section.

3. The apparatus as defined in claim 2 including a generally vertical channel of U-shaped transverse cross-sectional configuration housed in each U-shaped side wall portion, and said nozzle means being housed in said channel.

4. An apparatus for washing articles comprising a housing having an entrance opening and an exit opening, means for conveying a carrier carrying articles to be washed from said entrance opening to said exit opening, said housing setting off a washing zone contiguous said entrance opening and a rinse zone contiguous said exit opening, nozzle means in said washing zone for directing a plurality of streams of water against articles conveyed through said washing zone by the carrier, nozzle means in said rinse zone for directing a plurality of streams of water against articles conveyed through said rinse zone by the carrier, said washing zone nozzle means include a plurality of nozzles, said plurality of nozzles being disposed in a generally inverted U-shaped configuration as viewed in elevation whereby the streams are directed both downwardly and across the width of said washing zone, said rinse zone nozzle means include a plurality of nozzles disposed in a generally T-shaped configuration, as viewed in top plan, at an upper area of said rinse zone which directs the streams of rinse water generally downwardly, across the width and along the length of said rinse zone, said T-shaped configuration being defined by a leg disposed generally along a longitudinal centerline of said housing and an arm transverse thereto.

5. The apparatus as defined in claim 4 including another plurality of nozzles in said washing zone being disposed in a generally inverted U-shaped configuration as viewed in elevation, said first and second mentioned washing zone nozzles being spaced from each other lengthwise of said housing, and additional nozzles disposed across the width of said housing between said first and second mentioned washing zone nozzles at a lower area of said washing zone which direct streams of water across the width of and upwardly in said washing zone.

6. The apparatus as defined in claim 4 wherein said housing includes opposite side walls and said side walls being recessed for receiving therein and protecting nozzles carried by legs of said plurality of washing zone nozzles housed in said recessed side walls.

7. The apparatus as defined in claim 4 wherein said inverted U-shaped configuration of said washing zone nozzles is defined by a pair of vertical parallel pipes and a bight pipe therebetween, said pipes carry said washing zone nozzles, said housing includes opposite side walls, said side walls being recessed and opening toward each other in opposing relationship, and said vertical parallel pipes and the wash zone nozzles associated therewith being housed in and protected by said recessed side walls.

8. The apparatus as defined in claim 7 including a generally vertical channel of U-shaped transverse cross-sectional configuration housed in each recessed side wall, and said vertical parallel pipes being each disposed in an associated U-shaped channel.

9. Apparatus for washing articles comprising a generally tunnel-like housing defined by a top wall and a pair of spaced side walls, said housing having a generally open bottom set-off between lowermost longitudinal edges of said side walls, said housing having an entrance opening and an exit opening, a substrate upon which said housing rests, said substrate including means for defining a wash water reservoir adjacent said entrance opening and means for defining a rinse water reservoir adjacent said exit opening, said wash water and rinse water reservoirs being housed generally beneath said top wall and within said side walls except for at least one portion of each of said wash water and rinse water reservoirs which is outboard of at least one of said side walls, means for conveying a carrier carrying articles to be washed from said entrance opening to said exit opening, said conveying means including an endless conveyor between a pair of guide tracks in spanning relationship to said wash water and rinse water reservoirs generally longitudinally of said housing, said housing setting off a washing zone contiguous said entrance opening and said wash water reservoir and a rinse zone contiguous said exit opening and said rinse water reservoir, nozzle means in said washing zone for directing a plurality of streams of wash water upwardly, downwardly and sidewise against articles conveyed through said washing zone by said endless conveyor, nozzle means in said rinse zone for directing a plurality of streams of rinse water against articles conveyed through said rinse zone by said endless conveyor, said rinse water nozzle means and said wash water nozzle means being carried by respective rinse water and wash water pipes having respective nozzles defining outlets within said housing and each pipe having an inlet outboard of said housing, said rinse water pipe inlet and wash water pipe inlet being connected to respective outlets of rinse water and wash water pumps, a rinse water reservoir pipe and a wash water reservoir pipe for conducting rinse water and wash water respectively from said respective rinse water reservoir and said wash water reservoir to inlets of said respective rinse water and wash water pumps, means for driving said pumps to continuously circulate the rinse water and wash water, motor means for driving said endless conveyor, and said motor means and rinse water and wash water pumps being disposed exteriorly of said housing.

10. The apparatus as defined in claim 9 including means for detecting the level of rinse water in said rinse water reservoir, means for detecting the level of wash water in said wash water reservoir, and means responsive to the rinse water and wash water detecting means to add make-up water to the rinse and wash water.

11. The apparatus as defined in claim 10 wherein said rinse water and wash water detecting means are located in said respective rinse water and wash water reservoir portions.

* * * * *